US008764160B2

(12) United States Patent
Sunaoshi

(10) Patent No.: US 8,764,160 B2
(45) Date of Patent: Jul. 1, 2014

(54) LIQUID TREATMENT AGENT COATING DEVICE FOR INKJET PRINTER, METHOD OF OPERATING LIQUID TREATMENT AGENT COATING DEVICE, AND IMAGE FORMING SYSTEM

(71) Applicant: Masayuki Sunaoshi, Ibaraki (JP)

(72) Inventor: Masayuki Sunaoshi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/654,857

(22) Filed: Oct. 18, 2012

(65) Prior Publication Data

US 2013/0106946 A1 May 2, 2013

(30) Foreign Application Priority Data

Oct. 26, 2011 (JP) ..... 2011-235088

(51) Int. Cl.
*B41J 2/015* (2006.01)

(52) U.S. Cl.
USPC ..... 347/21

(58) Field of Classification Search
CPC ..... B41J 2/2114; B41J 2/015; B41J 11/0015; B41J 11/002; B41J 29/38; B41J 2/01; B41J 2/14233; B41J 2/17513; B41J 2/17553; B41J 11/0085; B41J 2002/012; B41J 2002/14241; B41J 2002/14266; B41J 25/308; B41J 2/0057; B41J 2/135; B41J 2/155; B41J 2/1606; B41J 2/1752; B41J 2/2107; B41J 2/211; B41J 2/2117; B41J 2/2121; B41J 2/2128; B41J 3/4075; B41J 3/543
USPC ..... 347/21
See application file for complete search history.

(56) References Cited

U.S. PATENT DOCUMENTS

| | | | | | |
|---|---|---|---|---|---|
| 2,232,069 | A * | 2/1941 | Ives | ..... | 427/345 |
| 4,591,875 | A * | 5/1986 | McCann | ..... | 347/86 |
| 4,658,274 | A * | 4/1987 | DeYoung | ..... | 347/88 |
| 8,038,284 | B2 * | 10/2011 | Hori et al. | ..... | 347/103 |

FOREIGN PATENT DOCUMENTS

| | | | | |
|---|---|---|---|---|
| JP | 7-156538 | | 6/1995 | |
| JP | 1995-156538 | * | 6/1995 | ..... B41M 5/00 |
| JP | 2002-096454 | | 4/2002 | |
| JP | 2011-183336 | | 9/2011 | |

OTHER PUBLICATIONS

US BPAI Ex Parte Shirley, Appeal 2009-2352, May 14, 2009.*

* cited by examiner

*Primary Examiner* — Alessandro Amari
*Assistant Examiner* — Michael Konczal
(74) *Attorney, Agent, or Firm* — Oblon, Spivak, McClelland, Maier & Neustadt, L.L.P.

(57) ABSTRACT

Disclosed is a liquid treatment agent coating device including a coating roller that coats a recording medium with a liquid treatment agent; a pressing roller that cooperates with the coating roller to nip and convey the recording medium; a first container that holds the coating roller and the liquid treatment agent, wherein the first container has an opening portion in the vicinity of a nip portion between the coating roller and the pressing roller; a second container that accommodates an amount of the liquid treatment agent held in the first container, wherein the second container has second airtightness that is greater than first airtightness of the first container; a removal channel extending from the first container to the second container; a first on-off valve disposed in the removal channel; and a return channel extending from the second container to the first container.

6 Claims, 11 Drawing Sheets

LIQUID TREATMENT AGENT COATING DEVICE FOR INKJET PRINTER, METHOD OF OPERATING LIQUID TREATMENT AGENT COATING DEVICE, AND IMAGE FORMING SYSTEM

BACKGROUND OF THE INVENTION

1. Field of the Invention

Embodiments of the present invention relate to a liquid treatment agent coating device, a method of operating the liquid treatment agent coating device, and an image forming system. The liquid treatment agent coating device is for an inkjet printer that forms an image on a recording medium by discharging ink droplets. The liquid treatment agent coating device coats the recording medium with a liquid treatment agent prior to forming the image. The liquid treatment agent is, for example, a blur inhibitor that inhibits an image blur that may occur during recording by the inkjet printer.

2. Description of the Related Art

An inkjet image forming method has rapidly been adopted in recent years owing to an advantageous property that the method is easily enhanced for a method of forming color images, as well as properties that the method is noiseless and has a low running cost. However, when an image is formed by the inkjet image forming method on a recording medium other than dedicated paper, there may be problems in quality of the formed image at an earlier stage, such as blurring, density unevenness, color tone unevenness, and bleed-through. Additionally, there may be problems in robustness of the formed image, such as water resistance and weather resistance. Therefore, some techniques have been proposed to solve these problems.

There is a method for solving these problems. In the method, quality of an image is improved by coating a sheet of paper (as a recording medium) with a liquid treatment agent prior to the ink droplets being adhered to the sheet of paper. The liquid treatment agent functions to condense the ink. As the method of coating the recording medium with the liquid treatment agent, Patent Document 1 (Japanese Patent Laid-Open Application No. H7-156538) discloses a method of coating an entire surface of a recording medium with a liquid treatment agent by using a roller.

FIG. 10 is a schematic configuration diagram of a conventional liquid treatment agent coating device for coating the recording medium with the liquid treatment agent by using the roller. As shown in FIG. 10, the recording medium is wound around a peripheral surface of a platen roller 201 by using a pressing chuck 202. The platen roller 201 is rotationally driven by a driving source such as a motor (not shown).

On the other hand, a liquid treatment agent 205 is reserved in a liquid treatment agent tank 204. The liquid treatment agent 205 is transferred onto a roller surface of a coating roller 208 as a thin film by an agitation-supply roller 206 and conveyance-thinning rollers 207*a* and 207*b*.

The coating roller 208 rotates while being pressed onto the recording medium 203, which has been wound around the platen roller 201 being rotated, thereby coating the surface of the recording medium 203 with the liquid treatment agent 205. When a portion of the recording medium 203, which has been coated with the liquid treatment agent 205, reaches a position facing an inkjet recording head 209, the inkjet recording head 209 discharges ink droplets, thereby performing the recording.

As described, according to the method of coating a recording area of the recording medium 203 with the liquid treatment agent 205 for improving image quality by using the coating roller 208, the recording area can be coated thinly with the liquid treatment agent 205 having a relatively higher viscosity, compared to a method where a recording area is processed by spraying a liquid treatment agent by using a spraying head. Therefore, the method of coating the recording area with the liquid treatment agent 205 has such an advantageous property that an image blur can further be prevented from occurring.

However, for such a conventional liquid treatment agent coating device, it has not been considered that, when the liquid treatment agent has been reserved for a long time in the liquid treatment agent coating device, viscosity of the liquid treatment agent increases due to evaporation of water or an organic solvent in the liquid treatment agent. FIG. 11 is a characteristic diagram showing a relationship between viscosity of a liquid treatment agent and a coating amount of the liquid treatment agent per A4 size recording medium. As is clear from FIG. 11, the coating amount of the liquid treatment agent tends to be increased when the viscosity of the liquid treatment agent is increased.

When the coating amount of the liquid treatment agent is increased, the liquid treatment agent may bleed on the recording medium. Therefore, a friction force between the recording medium and a roller that conveys the recording medium may be lowered. It can be a cause of a conveyance failure of the recording medium. Further, it is possible that the liquid treatment agent is not sufficiently dried. In such a case, it is possible that the formed image is transferred to another recording medium in a post process. Therefore, there are some problems in that the image quality is lowered and that speeding up of the image forming system is prevented.

SUMMARY OF THE INVENTION

The embodiments of the present invention have been developed in view of the above-described problems of the conventional techniques.

An objective of the present invention is to provide a liquid treatment agent coating device for an inkjet printer that can effectively regulate an increase of a coating amount of a liquid treatment agent due to an increase of viscosity of the liquid treatment agent; a method of operating the liquid treatment agent coating device; and an image forming system with which high quality images are obtained by performing suitable pre-processing.

In one aspect, there is provided a liquid treatment agent coating device for an inkjet printer, the liquid treatment agent coating device including a coating roller configured to coat a recording medium with a liquid treatment agent prior to forming an image on the recording medium; a pressing roller configured to cooperate with the coating roller to nip and convey the recording medium, wherein the pressing roller is configured to transfer the liquid treatment agent on the coating roller by pressing the recording medium toward the coating roller; a first container configured to store the coating roller and the liquid treatment agent, wherein the first container has an opening portion in the vicinity of a nip portion between the coating roller and the pressing roller; a second container configured to accommodate an amount of the liquid treatment agent stored in the first container, wherein the second container has second airtightness that is greater than first airtightness of the first container; a removal channel extending from the first container to the second container; a first on-off valve disposed in the removal channel; and a return channel extending from the second container to the first container.

In another aspect, there is provided a method of operating a liquid treatment agent coating device for an inkjet printer, the liquid treatment agent coating device including a coating roller configured to coat a recording medium with a liquid treatment agent prior to forming an image on the recording medium; a pressing roller configured to cooperate with the coating roller to nip and convey the recording medium, wherein the pressing roller is configured to transfer the liquid treatment agent on the coating roller by pressing the recording medium toward the coating roller; a first container configured to store the coating roller and the liquid treatment agent, wherein the first container has an opening portion in the vicinity of a nip portion between the coating roller and the pressing roller; a second container configured to accommodate an amount of the liquid treatment agent stored in the first container, wherein a second container has second airtightness that is greater than first airtightness of the first container; a removal channel extending from the first container to the second container; a first on-off valve disposed in the removal channel; a return channel extending from the second container to the first container; a supply channel configured to supply the liquid treatment agent to the first container, the supply channel being connected to the return channel; a cartridge configured to be detachably connected to the supply channel, wherein the cartridge is connected to the supply channel at a portion of the supply channel which is opposite to a third connection point at which the supply channel is connected to the return channel, the cartridge being filled with the liquid treatment agent; a first liquid amount detection sensor configured to detect the amount of the liquid treatment agent stored in the first container; and a second liquid amount detection sensor configured to detect a second amount of the liquid treatment agent stored in the second container, wherein, when the second liquid amount detection sensor detects that the liquid treatment agent is not stored in the second container, the liquid treatment agent stored in the cartridge is supplied to the first container through the supply channel, and when the first liquid amount detection sensor subsequently detects that a predefined amount of the liquid treatment agent has been supplied to the first container, the supply of the liquid treatment agent from the cartridge is terminated, wherein, when the second liquid amount detection sensor detects that the liquid treatment agent is stored in the second container, the liquid treatment agent stored in the second container is returned to the first container through the return channel, and when the second liquid amount detection sensor subsequently detects that the liquid treatment agent is not stored in the second container, the first liquid amount detection sensor detects whether a first stored amount of the liquid treatment agent stored in the first container reaches the predefined amount, and wherein, when the first liquid amount detection sensor subsequently detects that the first stored amount of the liquid treatment agent stored in the first container does not reach the predefined amount, a shortage amount of the liquid treatment agent is supplied from the cartridge.

In another aspect, there is provided an image forming system including a liquid treatment agent coating device configured to coat a recording medium with a liquid treatment agent prior to forming an image on the recording medium; and an inkjet printer configured to form the image by discharging ink droplets onto the recording medium having been coated with the liquid treatment agent, wherein the liquid treatment agent coating device is disposed upstream in a conveyance direction of the recording medium, and the inkjet printer is disposed downstream of the liquid treatment agent coating device in the conveyance direction of the recording medium, wherein the liquid treatment agent coating device is for the inkjet printer, and wherein the liquid treatment agent coating device includes a coating roller configured to coat the recording medium with the liquid treatment agent prior to forming the image on the recording medium; a pressing roller configured to cooperate with the coating roller to nip and convey the recording medium, wherein the pressing roller is configured to transfer the liquid treatment agent on the coating roller by pressing the recording medium toward the coating roller; a first container configured to store the coating roller and the liquid treatment agent, wherein the first container has an opening portion in the vicinity of a nip portion between the coating roller and the pressing roller; a second container configured to accommodate an amount of the liquid treatment agent stored in the first container, wherein the second container has second airtightness that is greater than first airtightness of the first container; a removal channel extending from the first container to the second container; a first on-off valve disposed in the removal channel; and a return channel extending from the second container to the first container.

According to the embodiments of the present invention, there are provided the liquid treatment agent coating device for the inkjet printer that can effectively regulate the increase of the coating amount of the liquid treatment agent due to the increase of the viscosity of the liquid treatment agent and the method of operating the liquid treatment agent coating device. Further, there is provided the image forming system with which the high quality images are obtained by performing the suitable pre-processing.

Other objects, features and advantages of the present invention will become more apparent from the following detailed description when read in conjunction with the accompanying drawings.

DETAILED DESCRIPTION OF THE PREFERRED EMBODIMENTS

Figure 1:
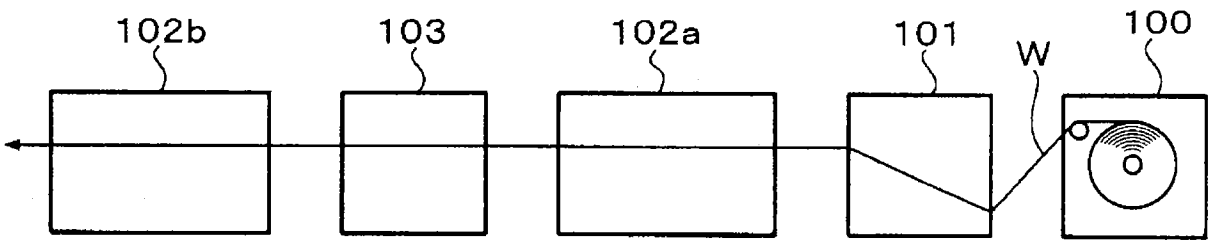
FIG. 1 is a flowchart schematically showing a process flow of an image forming system according to an embodiment of the present invention.

Hereinafter, an embodiment of the present invention will be explained by referring to accompanying figures. FIG. 1 is a flowchart schematically showing a process flow of an image forming system according to the embodiment of the present invention.

As shown in FIG. 1, a recording medium W, which is formed of, for example, a continuous paper web, is pulled out from a paper feeder 100. The recording medium W is fed to a liquid treatment agent coating device 101. Front and rear surfaces of the recording medium W are coated with a liquid treatment agent such as a blur inhibitor, thereby performing a pre-process. Subsequently, the recording medium W is fed to a first inkjet printer 102*a*, and the first inkjet printer 102*a* forms a desired image on the front surface of the recording medium W by discharging ink droplets. After that, a paper inverter 103 inverts the front surface and the rear surface of the recording medium W. Then, the recording medium W is fed to a second inkjet printer 102*b*, and the second inkjet printer 102*b* forms a desired image on the rear side of the recording medium W by discharging ink droplets. In this manner, in the image forming system, both sides of the recording medium W are printed. Subsequently the recording medium W is conveyed to a post-processing device (not shown), and a predetermined post-process is performed.

Figure 2:
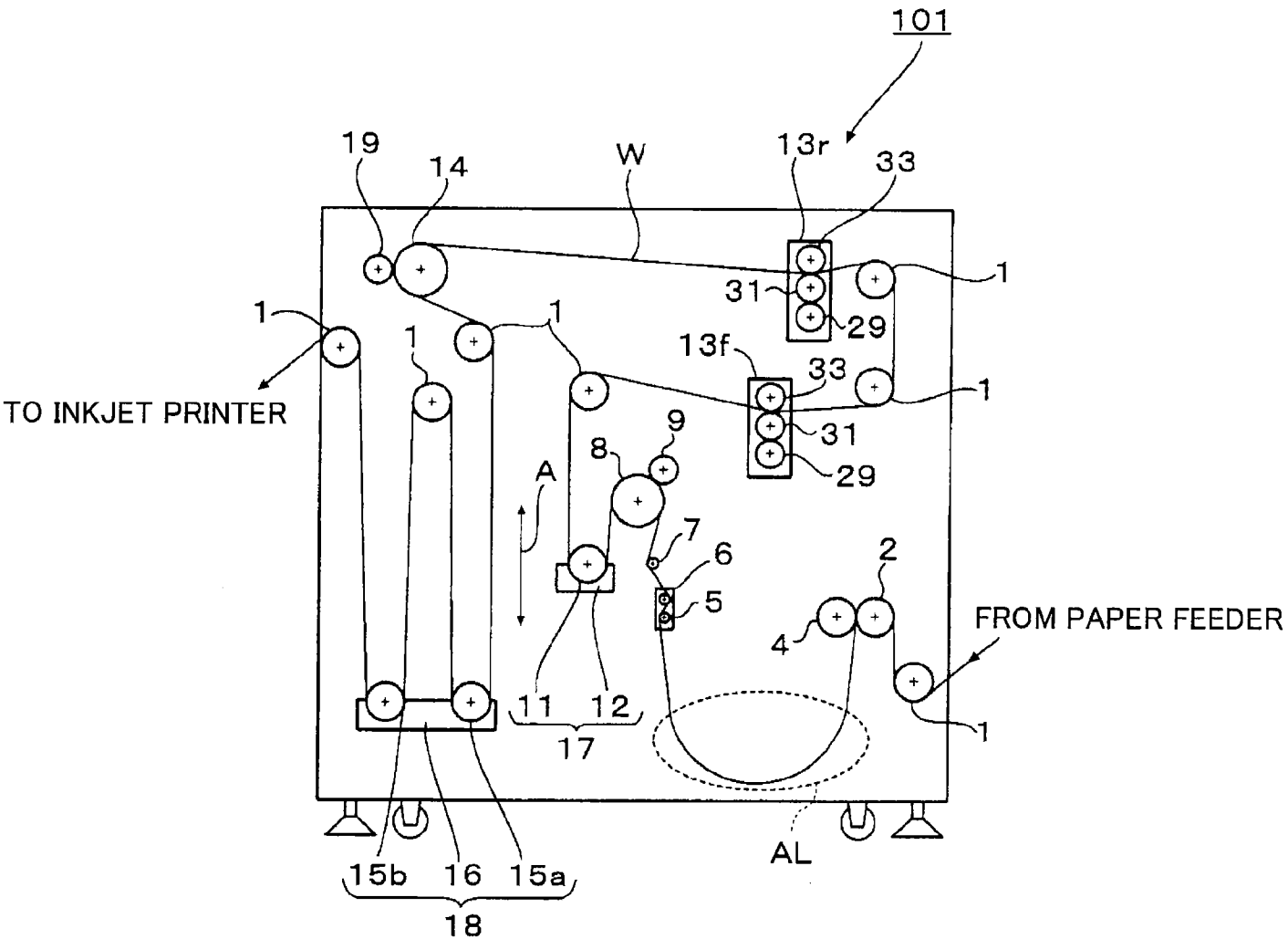
FIG. 2 is a schematic configuration diagram of a liquid treatment agent coating device utilized in the image forming system.

FIG. 2 is a schematic configuration diagram of the liquid treatment agent coating device 101 used for the image forming system. FIG. 2 shows a state where the recording medium W is coated with the liquid treatment agent. As shown in FIG. 2, plural rotatable guide rollers 1 with bearings (bearings are not shown) are disposed inside the liquid treatment agent coating device 101, thereby forming a conveyance path of the recording medium W.

In FIG. 2, an element indicated by a reference numeral 2 is a feed-in (FI) roller that is rotationally driven by a driving source (not shown) such as a motor. A feed-in nip roller 4 is pressed toward the FI roller 2 by a pulling force of a spring (not shown).

The recording medium W is elastically nipped between the FI roller 2 and the FI-nip roller 4. When the FI roller 2 is rotated by the driving source, the recording medium W is drawn into inside the liquid treatment agent coating device 101 from the paper feeder 100.

The recording medium W forwarded from the nip between the FI roller 2 and the FI-nip roller 4 is slightly loosened to form a loop AL. After passing through the loop AL, the recording medium W passes through a space including path shafts 5 and edge guides 6. Though it is not shown in FIG. 2, the two path shafts 5 are arranged in a direction perpendicular to a conveyance direction of the recording medium W (the direction of the arrow). The recording medium W passes through the space between the two path shafts 5, while forming an S-shape. The pair of edge guides 6 is attached to the two path shafts. Each of the edge guides 6 has a plate-like shape. A distance between the two edge guides 6 is adjusted to be substantially equal to a width of the recording medium W.

The two path shafts 5 and the pair of the edge guides 6 cooperate to regulate a moving position in the width direction of the recording medium W. Therefore, the recording medium W is stably conveyed. The edge guides 6 are fixed to the path shafts 5 by fixing units such as screws. The positions of the edge guides 6 can be adjusted depending on the width of the recording medium W to be used.

A fixed tension shaft 7 adds tension to the recording medium W that has passed through the space including the path shafts 5 and the edge guide 6 so as to stabilize the conveyance of the recording medium W.

After passing the tension shaft 7, the recording medium W passes through a nip between an in-feed roller 8 and feed-nip rollers 9. The in-feed roller 8 is driven by a driving source (not shown) such as a motor. Though it is not shown in FIG. 2, the plural feed-nip rollers 9 are disposed along a direction of an axis of the in-feed roller 8. The feed-nip rollers 9 are pressed toward the in-feed roller 8 by a spring (not shown).

After passing through a nip between the in-feed roller 8 and the feed-nip rollers 9, the recording medium W is wound around a rotatable first dancer roller 11 from a bottom side.

The first dancer roller 11 is rotatably attached to a first movable frame 12 through bearings (not shown) attached to end portions of the first dancer roller 11, thereby forming a first dancer roller assembly 17. Namely, the first dancer roller assembly 17 is suspended by the recording medium W.

The first dancer roller assembly 17 can be moved along a direction of gravity A. A first position detection unit (not shown) is provided for detecting a position of the first dancer roller assembly 17. The position of the first dancer roller assembly 17 can be adjusted by performing drive control of the driving source of the in-feed roller 8 depending on an output from the first position detection unit.

After passing through the first dancer roller assembly 17, both the front side and the rear side of the recording medium W are coated with the liquid treatment agent by sequentially passing through a front surface coating unit 13*f* for coating the front surface of the recording medium W with the liquid treatment agent and a rear surface coating unit 13*r* for coating the rear surface of the recording medium W with the liquid treatment agent. The front surface coating unit 13*f* and the rear surface coating unit 13*r* will be explained later.

After passing through the rear surface coating unit 13*r*, the recording medium W passes through a nip between an out-feed roller 14 and feed-nip rollers 19. The out-feed roller 14 is rotationally driven by a driving source (not shown) such as a motor. Though it is not shown in FIG. 2, the plural feed-nip rollers 19 are arranged along a direction of an axis of the out-feed roller 14. The feed-nip rollers 19 are pressed toward the out-feed roller 14 by a spring (not shown).

After passing through the nip between the out-feed roller 14 and the feed-nip rollers 19, the recording medium W is wound around rotatable second dancer rollers 15*a* and 15*b* and one of the guide rollers 1 disposed between the dancer rollers 15*a* and 15*b*, thereby forming a W-shape.

The two second dancer rollers 15*a* and 15*b* are rotatably attached to a second movable frame 16 through bearings (not shown) attached to end portions of the second dancer rollers 15*a* and 15*b*, thereby forming a second dancer roller assembly 18. Namely, the second dancer roller assembly 18 is also suspended by the recording medium W.

The second dancer roller assembly 18 can also be moved along the direction of gravity A. A second position detection unit (not shown) is provided for detecting a position of the second dancer roller assembly 18. The position of the second dancer roller assembly 18 can be adjusted by performing drive control of the driving source of the out-feed roller 14 depending on an output from the second position detection unit.

Figure 3:
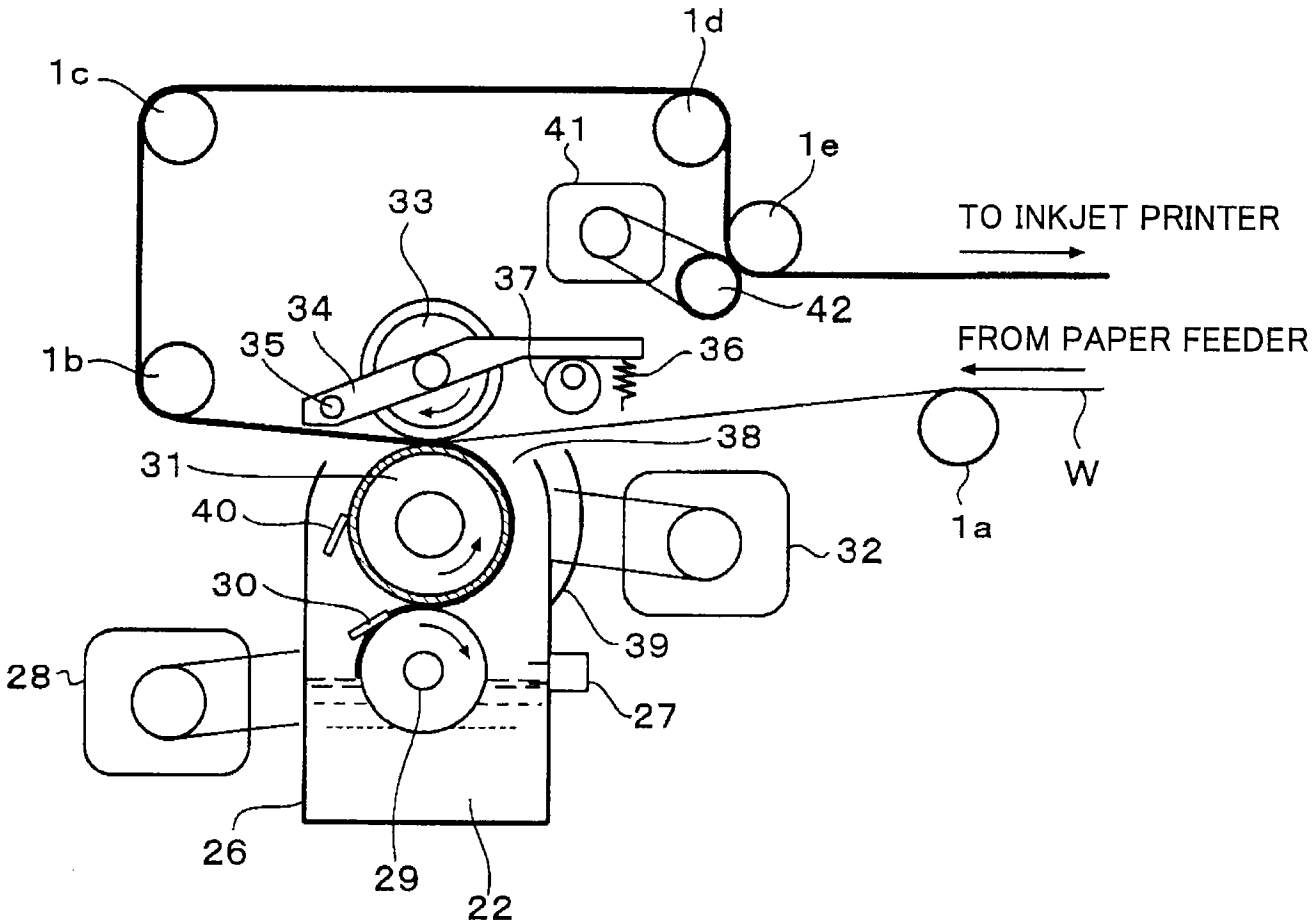
FIG. 3 is a schematic configuration diagram of a coating unit in the liquid treatment agent coating device.

FIG. 3 is a schematic configuration diagram of the coating unit 13 (any one of the front surface coating unit 13*f* and the rear surface coating unit 13*r*). As described later, the liquid treatment agent 22 is supplied to a supply container 26. As the liquid treatment agent 22, a solution of a water-soluble flocculant is utilized. Here, the solution is obtained by dissolving or dispersing the water-soluble flocculant, which promotes clumping or insolubilization of a water-soluble coloring material, in water or in an organic solvent.

An amount of the liquid treatment agent 22 in the supply container 26 is detected by a liquid surface detection sensor 27 attached to the supply container 26. When the liquid treatment agent 22 has been consumed by repeating printing and consequently a position of a liquid surface of the liquid treatment agent 22 in the supply container 26 becomes lower than a predefined position, the liquid treatment agent 22 is supplied to the supply container 26. When the position of the liquid surface of the liquid treatment agent 22 in the supply container 26 reaches the predefined position, the supplying of the liquid treatment agent 22 is terminated based on a detection signal of the liquid surface detection sensor 27. In this manner, the amount of the liquid treatment agent 22 in the supply container 26 is held to be a constant amount.

The liquid treatment agent 22 held in the supply container 26 is pumped up by rotation of a squeeze roller 29 driven by a motor 28. As the squeeze roller 29, a roller may be utilized such that grooves have been formed on a peripheral surface of the roller. For example, an anilox roller or a wire bar may be utilized. In such a case, since the roller may not be affected by the viscosity of the liquid treatment agent 22 or a printing speed during pumping up, it is easy to control the amount of the liquid.

Subsequent to the pumping up of the liquid treatment agent 22 by the squeeze roller 29, an amount in excess of the liquid treatment agent 22 is removed by a metering blade 30, and a predefined amount of the liquid treatment agent 22 is conveyed to a nip portion between the squeeze roller 29 and a coating roller 31. As a material of the metering blade 30, a metal such as a stainless steel, a plastic, and a rubber may be considered. However, from the viewpoints of wearing-out, the function to remove the redundant liquid, and a useful service life of the squeeze roller 29, a plastic material is preferable.

After the liquid treatment agent 22 has been conveyed to a nip portion between the squeeze roller 29 and the coating roller 31, the liquid treatment agent 22 is transferred onto the coating roller 31, while being uniformly spread in the direction of the axis of the nip portion between the squeeze roller 29 and the coating roller 31. A peripheral surface of the coating roller 31 is covered with an elastic material such as a rubber, and the coating roller 31 is rotationally driven by a motor 32.

The recording material W being nipped and conveyed between the coating roller 31 and a pressing roller 33 is coated with the liquid treatment agent 22 that has been transferred onto the coating roller 31. The pressing roller 33 is rotatably supported by an approximately center position of a swingable arm 34 through a bearing (not shown). The pressing roller 33 is rotated by the recording medium W being conveyed. A tension spring 36 is connected to an end portion opposite to a swing center 35 of the arm 34. The pressing roller 33 is pressed toward the coating roller 31 by a lever force.

An eccentric cam 37 is disposed between the pressing roller 33 and the tension spring 36, and the eccentric cam 37 contacts the arm 34. When the liquid treatment agent 22 is not being applied, the pressing roller 33 can be moved upward against the tension of the tension spring 36 in a direction in which the pressing roller 33 is separated from the coating roller 31 by the rotation of the eccentric cam 37.

An upper portion of the supply container 26 is formed to cover the coating roller 31 which is held inside the supply container 26, and the supply container includes an opening portion 38 disposed in the vicinity of a position at which the pressing roller 33 contacts and separates from the coating roller 31. The opening portion 38 includes an openable and closable shutter 39 so as to prevent water or an organic solvent of the liquid treatment agent 22 from evaporating. As shown in FIG. 3, when the pressing roller 33 is moved toward the coating roller 31, the shutter 39 is opened, and when the pressing roller 33 is separated from the coating roller 31, the shutter 39 is closed. After the liquid treatment agent 22 has been transferred from the coating roller 31 onto the recording medium W, the coating roller 31 is cleaned by a cleaner blade 40, and the coating roller 31 is prepared for a next coating with the liquid treatment agent 22.

As shown in FIG. 3, around the pressing roller 33, plural guide rollers 1*a*-1*e* are rotatably disposed at corresponding suitable positions. Among the plural guide rollers 1*a*-1*e*, the guide roller 1*e* is disposed to face a conveyance roller 42 that is rotationally driven by a motor 41.

The continuous recording medium W supplied from the paper feeder 100 (cf. FIG. 1) is nipped between the guide roller 1*e* and the conveyance roller 42. The recording medium W is pulled by the rotationally driven conveyance roller 42 and the guide roller 1*e*, and thereby the recording medium W is conveyed along the guide rollers 1*a*-1*e*.

After being coated with the liquid treatment agent 22 by the coating roller 31, the recording medium W is conveyed to the inkjet printers 102*a* and 102*b* (cf. FIG. 1).

Figure 4:
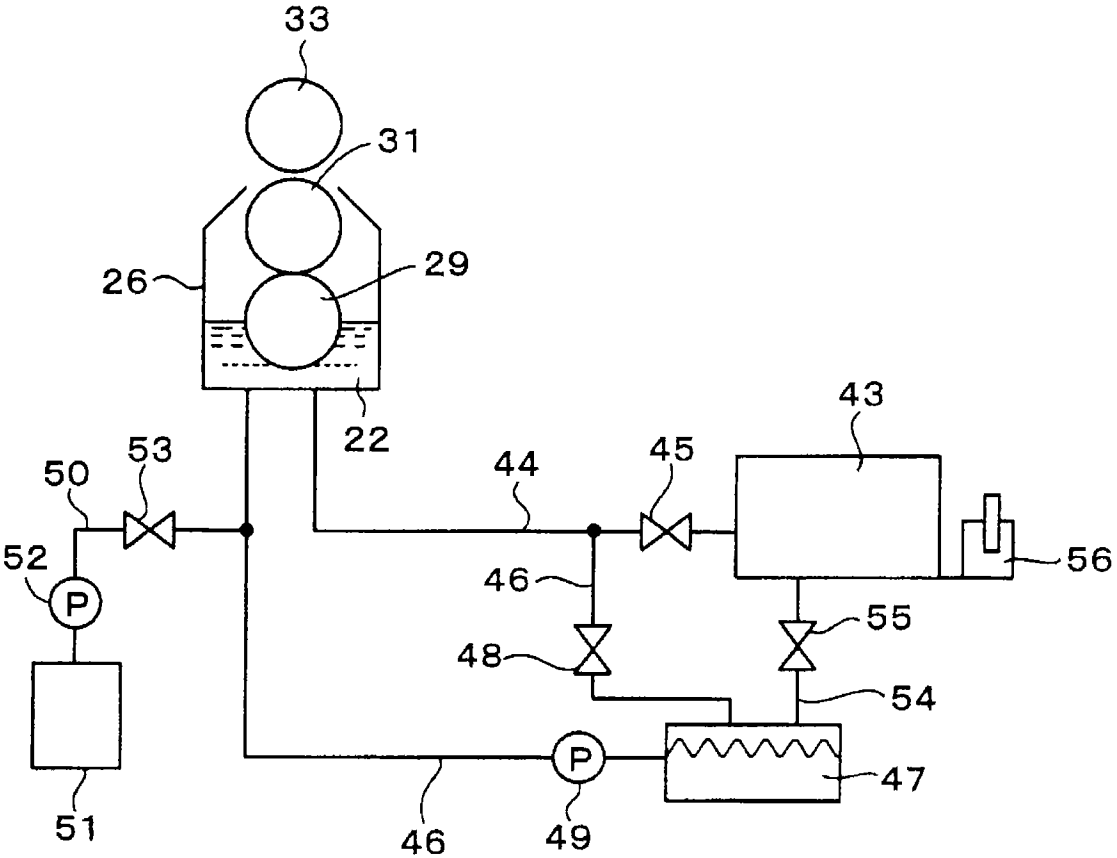
FIG. 4 is a diagram illustrating a process of supplying a liquid treatment agent to a supply container of the liquid treatment agent coating device, and illustrating a circulation system.

FIG. 4 is a diagram illustrating a process of supplying the liquid treatment agent 22 to the supply container 26 and illustrating a circulation system. As shown in FIG. 3, the upper portion of the supply container 26 is opened for nipping and conveying the recording medium W at the nip portion between the coating roller 31 and the pressing roller 33, and for coating the recording medium W with the liquid treatment agent 22. Even if the shutter 39 is provided, it is difficult to realize a completely sealed structure (a closed system).

Therefore, in the embodiment, a reservoir tank 43 having a substantially sealed structure is provided concurrently with the supply container 26. The reservoir tank 43 includes a container portion that can store the liquid treatment agent 22 held in the supply container 26. As shown in FIG. 4, the reservoir tank 43 communicates with the supply container 26 through a removal channel 44. An electromagnetic valve 45 is disposed in the removal channel 44 in front of the reservoir tank 43.

The reservoir tank 43 is disposed at a lower position with respect to the position of the supply tank 26, so that a hydraulic head difference is generated between the supply container 26 and the reservoir tank 43. When the liquid treatment agent 22 is not utilized for a long time, the liquid treatment agent 22 is moved from the supply container 26 to the reservoir tank 43 having high airtightness by opening the electromagnetic valve 45 and by using the hydraulic head difference. In this manner, there is prevented an increase of the viscosity of the liquid treatment agent 22 due to drying.

It may be a trigger for opening the electromagnetic valve 45 when the printing is stopped for a longer time, such as for one hour, compared to a processing time for a normal print job. For example, when the printing is stopped for a long time for replacing the recording medium W in the liquid treatment agent coating device 101 or for changing a printing pattern, the electromagnetic valve 45 may be opened. In this manner, a waiting time for filling the supply container 26 with the liquid treatment agent 22 is avoided each time the printing is stopped.

Further, for the electromagnetic valve 45, a normal open type valve is utilized. In a normal state where electricity is turned off, the electromagnetic valve 45 is opened. When the electricity of the liquid treatment agent coating device 101 is turned off, the liquid treatment agent 22 in the supply container 26 is automatically removed and stored in the reservoir tank 43, thereby preventing the liquid treatment agent 22 from being held for a long time in the supply container 26, which has low airtightness.

As shown in FIG. 4, a circulation channel 46 branches off from the removal channel 44 in the middle. A tip portion of the circulation channel 46 is connected to the supply container 26. A filter unit 47 is disposed in between the portions of the circulation channel 46. An electromagnetic valve 48 is disposed between the filter unit 47 and a connection point at which the circulation channel 46 is connected to the removal channel 44. On the other hand, a circulation pump 49 is disposed at a side of an exit of the filter unit 47.

A supply channel 50 is connected in between the circulation pump 49 and a connection point near which the circulation channel 46 is connected to the supply container 26. A cartridge 51 having a sealed structure is connected to a free end side of the supply channel 50. The cartridge 51 is replaceable and filled with the liquid treatment agent 22. Further, a supply pump 52 and an electromagnetic valve 53 are disposed in the middle of the supply channel 50.

A circulation supply channel 54 is provided for communicating between the reservoir tank 43 and the filter unit 47. An electromagnetic valve 55 is disposed in the middle of the circulation supply channel 54. Further, the reservoir tank 43 is provided with a liquid surface detection sensor 56. The liquid surface detection sensor 56 monitors an amount of the liquid treatment agent 22 in the reservoir tank 43. The removal channel 44, the circulation channel 46, the supply channel 50, and the circulation supply channel 54 are formed of corresponding tubes.

Hereinafter, there will be explained operations of systems included in the liquid treatment agent coating device 101 by referring to FIGS. 5-8.

<Operations to Supply the Liquid Treatment Agent 22>

Figure 5:
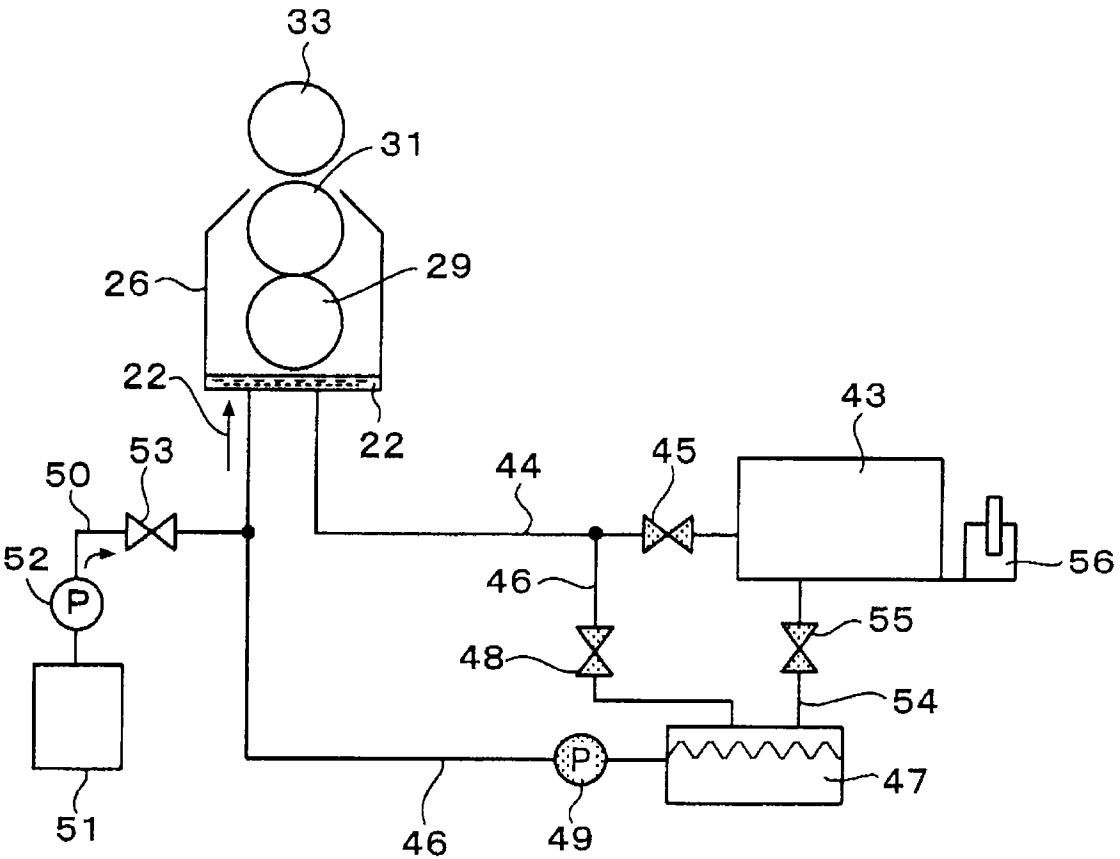
FIG. 5 is a diagram illustrating operations for supplying the liquid treatment agent from a state where a reservoir tank of the liquid treatment agent coating device does not store the liquid treatment agent.

FIG. 5 is a diagram illustrating operations for supplying the liquid treatment solution 22 from a state where the liquid treatment solution 22 is not stored in the reservoir tank 43. FIG. 5 shows a half-way state where the liquid treatment agent 22 is being supplied to the supply container 26.

In this case, as shown in FIG. 5, the electromagnetic valves 45, 48, and 55 are closed (in the figure, the electromagnetic valves are colored in black) and the circulation pump 49 is stopped (in the figure, the circulation pump 49 is colored in black). The liquid treatment agent 22 in the cartridge 51 is being supplied to the supply container 26 through the supply channel 50 and a portion of the circulation channel 46 by opening the electromagnetic valve 53 (in the figure, the electromagnetic valve 53 is colored in white) and driving the supply pump 52 (in the figure, the supply pump 52 is colored in white).

The liquid surface detection sensor 27 (cf. FIG. 3) monitors whether the amount of the liquid treatment agent 22 that has been supplied to the supply container 26 reaches a predefined value. When the amount of the liquid treatment agent 22 reaches the predefined value, the supply pump 52 is stopped based on a detection output from the liquid surface detection sensor 27, and the electromagnetic valve 53 is closed.

When the printing is continued and the liquid surface detection sensor 27 detects that the amount of the liquid treatment agent 22 in the supply container 26 has been decreased, the electromagnetic valve 53 is opened again, and the liquid treatment agent 22 in the cartridge 51 is supplied to the supply container 26 by driving the supply pump 52.

Figure 6:
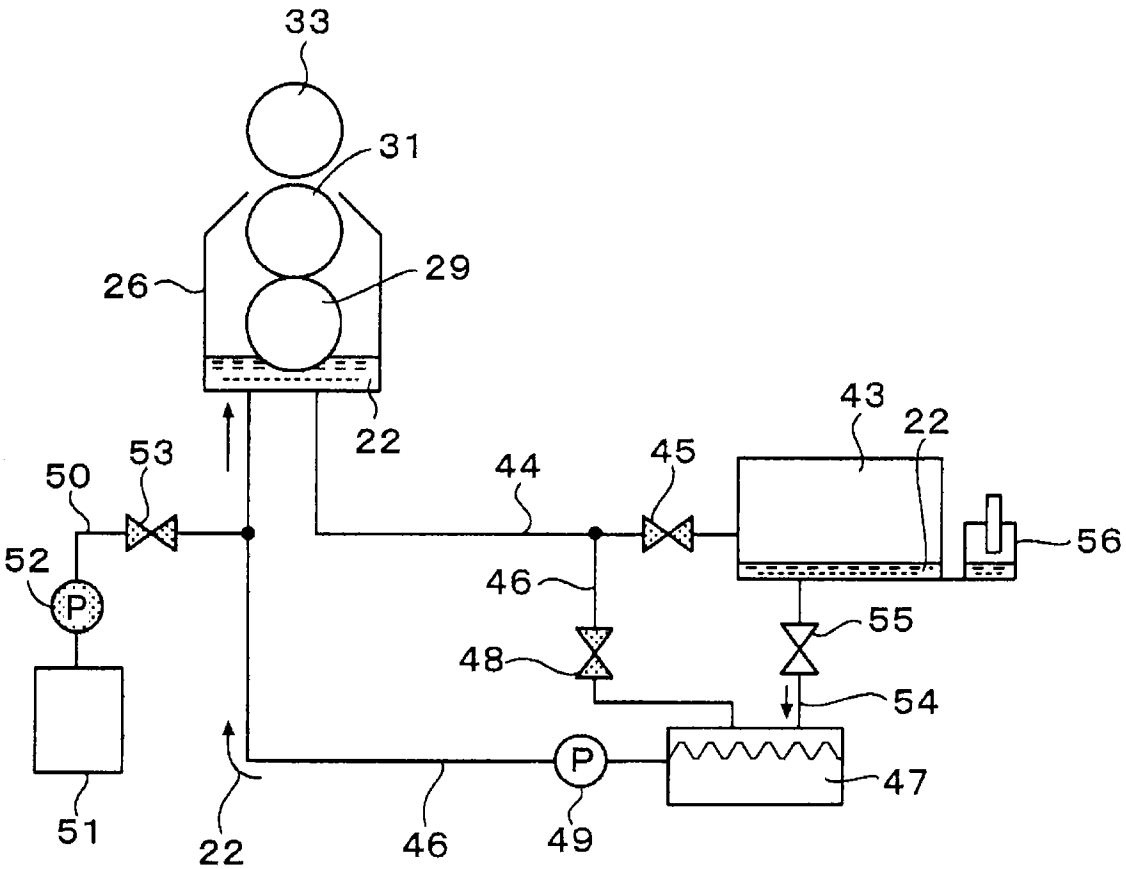
FIG. 6 is a diagram illustrating procedures to start operations for supplying the liquid treatment agent to the supply container from a state where the liquid treatment agent is stored in the reservoir tank of the liquid treatment agent coating device.

FIG. 6 is a diagram illustrating procedures to start operations for supplying the liquid treatment agent 22 to the supply container 26 from a state where the liquid treatment agent 22 has been stored in the reservoir tank 43. FIG. 6 shows a half-way state where the liquid treatment agent 22 in the reservoir tank 43 is being supplied to the supply container 26.

In this case, as shown in FIG. 6, the electromagnetic valves 45, 48, and 53 are closed (in the figure, the electromagnetic valves 45, 48, and 53 are colored in black), and the supply pump 52 is stopped (in the figure, the supply pump 52 is colored in black). The liquid treatment agent 22 in the reservoir tank 43 is supplied to the supply container 26 through the circulation supply channel 54 and a portion of the circulation channel 46 by opening the electromagnetic valve 55 (in the figure, the electromagnetic valve 55 is colored in white) and driving the circulation pump 49 (in the figure, the circulation pump 49 is colored in white).

When the liquid treatment agent 22 is being supplied to the supply container 26, the liquid treatment agent 22 passes through the filter unit 47, and thereby foreign materials, such as paper powder, included in the liquid treatment agent 22 are removed. The thus filtered liquid treatment agent 22 is supplied to the supply container 26. If the paper powder is mixed in the liquid treatment agent 22, the liquid treatment agent 22 becomes pasty and the viscosity of the liquid treatment agent 22 increases. Therefore, the foreign materials such as the paper powder are removed from the liquid treatment agent 22 at a certain frequency.

The liquid surface detection sensor 56 monitors whether discharging of the liquid treatment agent 22 in the reservoir tank 43 is completed. When the discharging of the liquid treatment agent 22 is completed, the electromagnetic valve 55 is closed and the circulation pump 49 is stopped.

At the time at which the removal of the liquid treatment agent 22 from the reservoir tank 43 has been completed, the liquid surface detection sensor 27 determines whether a predefined amount of the liquid treatment agent 22 has been supplied to the supply container 26. When the liquid surface detection sensor 27 determines that the amount of the liquid treatment agent 22 supplied to the supply container 26 has reached the predefined amount, the operations to supply the liquid treatment agent 22 are terminated. On the other hand, when the liquid surface detection sensor 27 determines that the amount of the liquid treatment agent 22 supplied to the supply container 26 has not reached the predefined amount, the liquid treatment agent 22 is supplied from the cartridge 51 through the procedures which have been explained by referring to FIG. 5.

An order of supplying the liquid treatment agent 22 is as follows. Namely, first, when liquid surface detection sensor 56 detects that the liquid treatment agent 22 is stored in the reservoir tank 43, the liquid treatment agent 22 stored in the reservoir tank 43 is moved to the supply container 26. Subsequently, when the liquid surface detection sensor 27 detects that the amount of the liquid treatment agent 22 held in the supply container 26 is insufficient, a deficient amount of the liquid treatment agent 22 is supplied from the cartridge 51.

It is not preferable to adopt a method of supplying the liquid treatment agent 22 in which the liquid treatment agent is supplied from the cartridge 51 to the supply container 26 while the liquid treatment agent 22 is still stored in the reservoir tank 43. In such a case, since an amount of the in-excess liquid treatment agent 22 is increased in the system, it is possible that the liquid treatment agent 22 overflows from the reservoir tank 43.

<Circulation Operation of the Liquid Treatment Agent 22>

Figure 7:
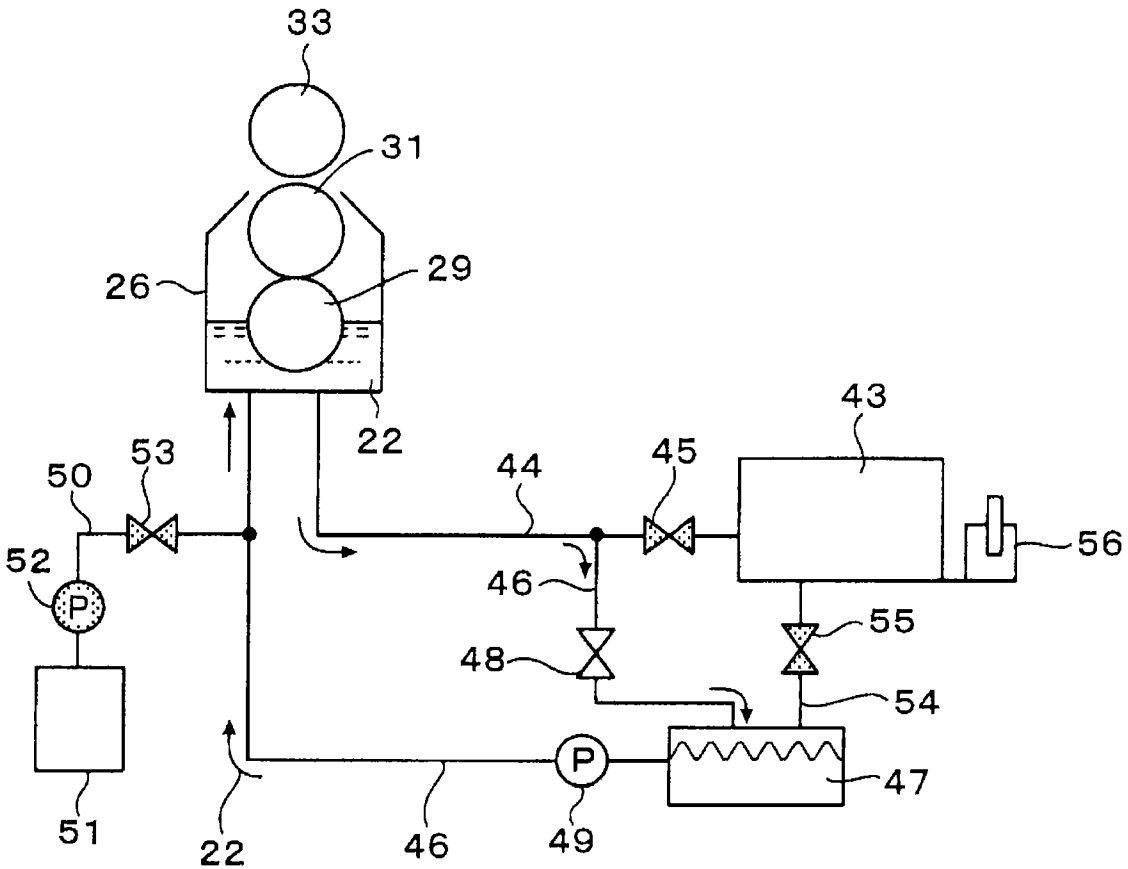
FIG. 7 is a diagram illustrating procedures of a circulation operation of the liquid treatment agent stored in the supply container of the liquid treatment agent coating device.

FIG. 7 is a diagram illustrating a circulation operation of the liquid treatment agent 22. FIG. 7 shows a state where the liquid treatment agent 22 is being circulated through a portion of the removal channel 44 and the circulation channel 46.

In this case, as shown in FIG. 7, the electromagnetic valves 45, 53, and 55 are closed (in the figure, the electromagnetic valves 45, 53, and 55 are colored in black), and the supply pump 52 is stopped (in the figure, the supply pump 52 is colored in black). The liquid treatment agent 22 is circulated through the portion of the removal channel 44 and the circulation channel 46 by opening the electromagnetic valve 48 (in the figure, the electromagnetic valve 48 is colored in white) and driving the circulation pump 49 (in the figure, the circulation pump 49 is colored in white). At that time, the liquid treatment agent 22 passes through the filter unit 47, and thereby the foreign materials, such as the paper powder, are removed. The thus filtered liquid treatment agent 22 is returned to the supply container 26. During printing, the circulation operation of the liquid treatment agent 22 is suitably performed at every predetermined time interval.

<Removal Operation of the Liquid Treatment Agent 22>

Figure 8:
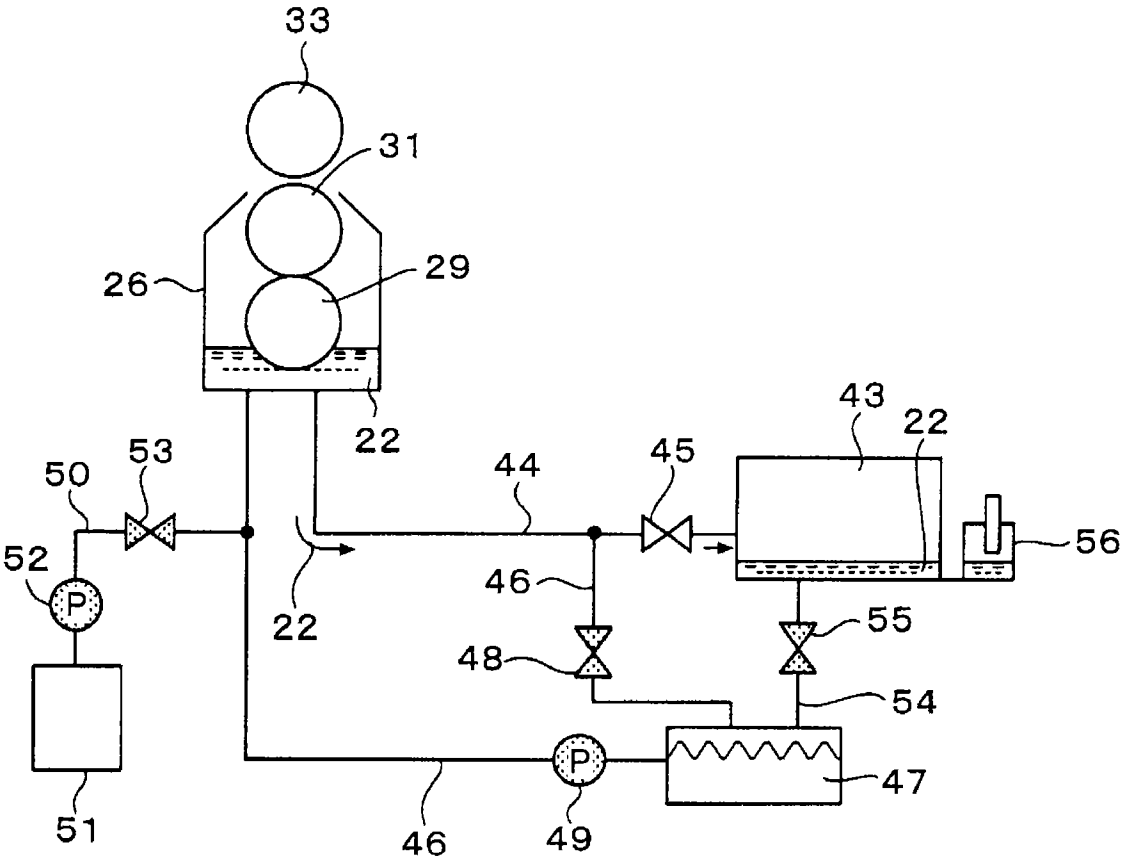
FIG. 8 is a diagram illustrating procedures of a removing operation of the liquid treatment agent stored in the supply container of the liquid treatment agent coating device.

FIG. 8 is a diagram illustrating a removal operation of the liquid treatment agent 22. FIG. 8 shows a half-way state of the removal operation.

In this case, as shown in FIG. 8, the electromagnetic valves 48, 53, and 55 are closed (in the figure, the electromagnetic valves 48, 53, and 55 are colored in black), and the circulation pump 49 and the supply pump 52 are stopped (in the figure, the circulation pump 49 and the supply pump 52 are colored in black). The liquid treatment agent 22 held in the supply container 26 is removed through the removal channel 44 by opening the electromagnetic valve 45 and by using the hydraulic head difference between the supply container 26 and the reservoir tank 43. In this manner, there is prevented an increase of the viscosity of the liquid treatment agent 22 due to drying.

The operations for returning the liquid treatment agent 22 in response to a request for printing which has been generated after the liquid treatment agent 22 has been removed from the supply container 26 is the same as the operations for supplying the liquid treatment agent 22 from the reservoir tank 43 to the supply container 26, which have been explained by referring to FIG. 6.

Figure 9:
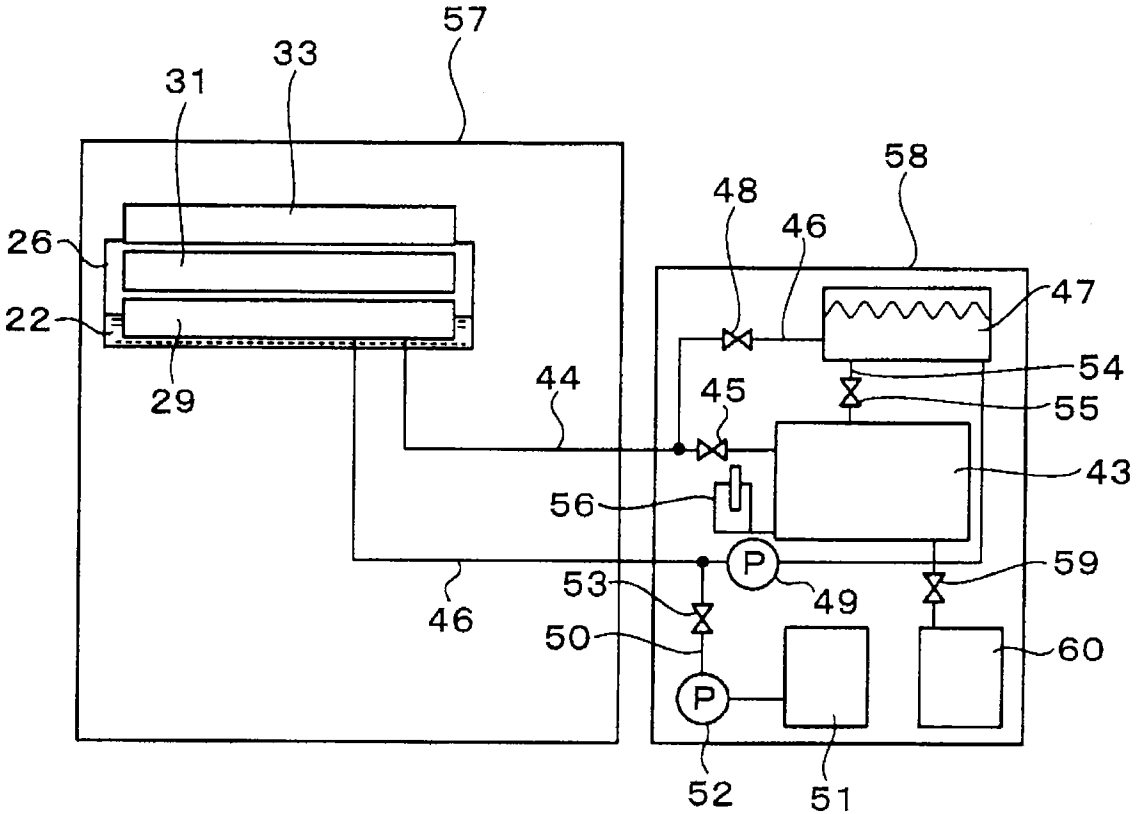
FIG. 9 is a diagram illustrating an arrangement of the supply container, the reservoir tank, a filter unit, and the like in the liquid treatment agent coating device.
Figure 10:
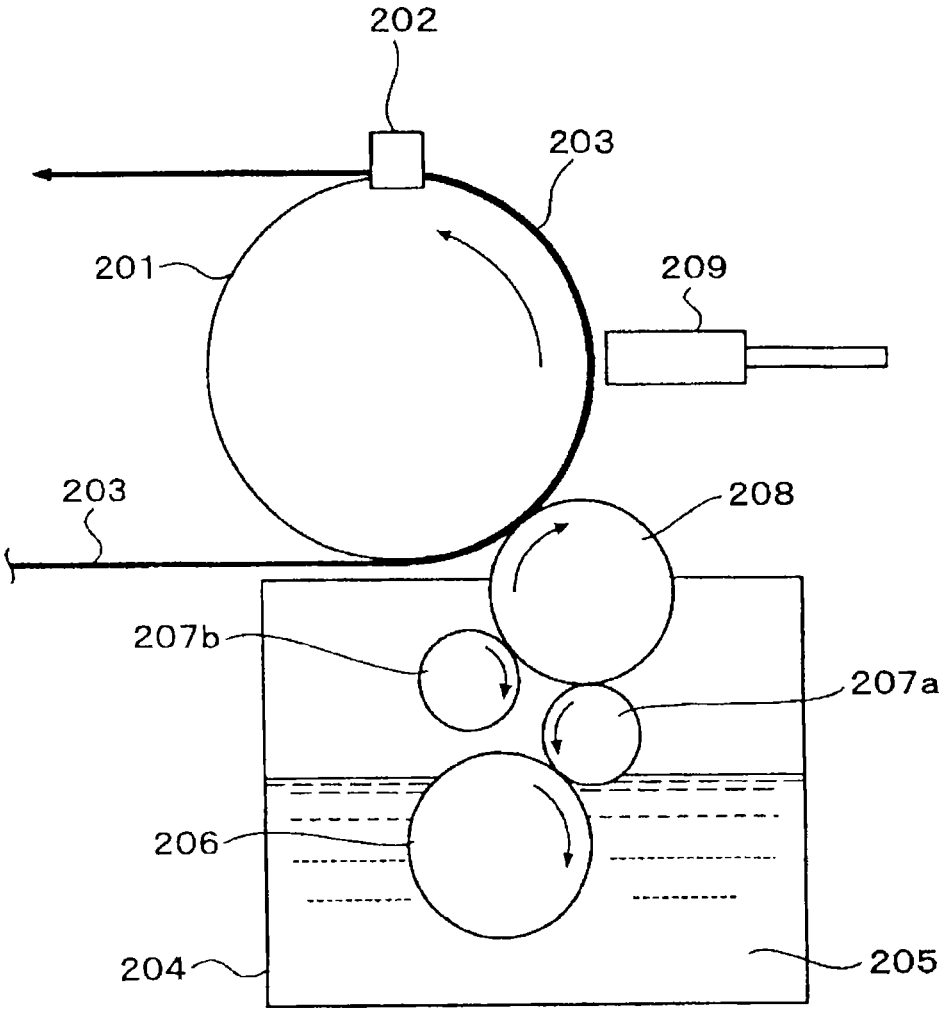
FIG.10 RELATED ART
FIG. 10 is a schematic configuration diagram of a conventional liquid treatment agent coating device.
Figure 11:
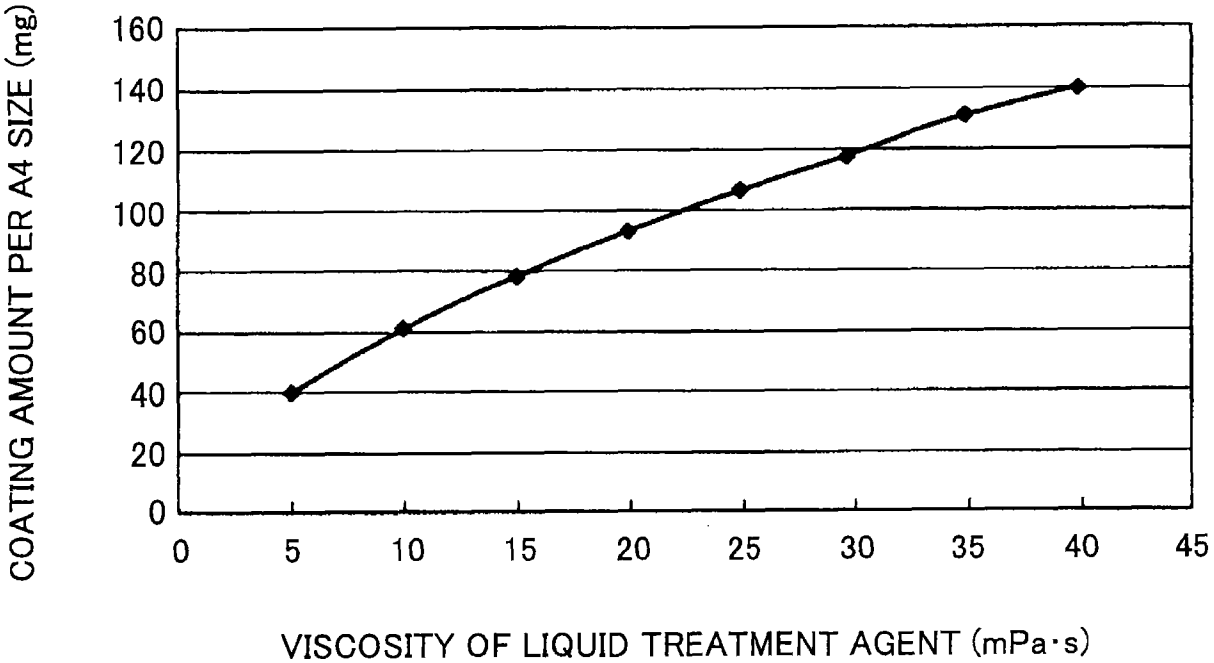
FIG. 11 is a characteristic diagram showing a relationship between viscosity of the liquid treatment agent and a coating amount of the liquid treatment agent per A4 size recording medium.

FIG. 9 is a diagram illustrating a state where the components such as the supply container 26, the reservoir tank 43, and the filter unit 47 are mounted in the liquid treatment agent coating device 101.

According to the embodiment, the liquid treatment agent coating device 101 is divided into a device main body 57 and an attached housing 58. The device main body 57 is disposed at a front side and the attached housing 58 is disposed at a rear side, when the liquid treatment agent coating device 101 is observed by an operator of the image forming system.

As shown in FIG. 9, the supply container 26 is mounted in the device main body 57 together with, for example, the dancer roller assemblies 17 and 18. On the other hand, the components such as the reservoir tank 43, the filter unit 47, the cartridge 51, and the pumps 49 and 52 are mounted in the attached housing 58. The device main body 57 and the attached housing 58 are connected through the removal channel 44 and the circulation channel 46.

In FIG. 9 the reference numeral 59 indicates a waste liquid electromagnetic valve, and the reference numeral 60 indicates a waste liquid tank. Since quality of the liquid treatment agent 22 tends to be lowered as the liquid treatment agent 22 is used, the liquid treatment agent 22 is discarded regularly or as required, and the liquid treatment agent 22 is renewed. Therefore, the waste liquid electromagnetic valve 59 and the waste liquid tank 60 are provided. Incidentally, in FIGS. 4-8, for the sake of simplicity of the figures, indications of the waste liquid electromagnetic valve 59 and the waste liquid tank 60 are omitted.

There has been explained the case of forming images on both sides of the recording medium W by referring to FIG. 1. However, single side printing is possible with this image forming system as it is. Specifically, when an image is formed only on one side of the recording medium W, the pressing roller 33 of the rear surface coating unit 13*r* of the liquid treatment agent coating device 101 is released from contacting the coating roller 31, and the paper inverter 103 and the second inkjet printer 102*b* are not used. In this manner, the single side printing may be performed.

Alternatively, the single printing may be performed by providing only one surface coating unit in a liquid treatment agent coating device and by coating one of the surfaces of the recording medium W with the liquid treatment agent 22. Further, the single printing may be performed by successively arranging two surface coating units in a liquid treatment agent coating device and by coating one of the surfaces of the recording medium W twice with the liquid treatment agent 22.

In the above description, the liquid treatment agent coating device for the inkjet printer, the method of operating the liquid treatment agent coating device, and the image forming system have been explained by the embodiments. However, the present invention is not limited to the above-described embodiments, and various modifications and improvements may be made within the scope of the present invention.

In the embodiment, the conveyance roller 42 is utilized as a conveyor of the recording medium W. However, the embodiment of the present invention is not limited to this. For example, another conveyance unit such as a conveyance tractor may be utilized.

In the embodiment, as shown in FIG. 4, the filter unit 47 is provided in between the portions of the circulation channel 46. However, the embodiment of the present invention is not limited to this. For example, the filter unit 47 may be disposed at a position between the supply container 26 and a branch point where the circulation channel 46 is separated from the removal channel 44.

The present application is based on Japanese Priority Application No. 2011-235088 filed on Oct. 26, 2011, the entire contents of which are hereby incorporated herein by reference.

What is claimed is:

1. A liquid treatment agent coating device for an inkjet printer, the liquid treatment agent coating device comprising:

a coating roller configured to coat a recording medium with a liquid treatment agent prior to forming an image on the recording medium;

a pressing roller configured to cooperate with the coating roller to nip and convey the recording medium, wherein the pressing roller is configured to transfer the liquid treatment agent on the coating roller by pressing the recording medium toward the coating roller;

a first container configured to hold the coating roller and the liquid treatment agent, wherein the first container has an opening portion in the vicinity of a nip portion between the coating roller and the pressing roller;

a second container configured to accommodate an amount of the liquid treatment agent held in the first container;

a removal channel extending from the first container to the second container;

a return channel extending from the second container to the first container; and a bypass channel extending from the removal channel to midstream of the return channel, wherein a first on-off valve is disposed between a first connection point and the second container, the bypass channel being connected to the removal channel at the first connection point, wherein a second on-off valve is disposed in the bypass channel, wherein a third on-off valve is disposed between a second connection point and the second container, the bypass channel being connected to the return channel at the second connection point, and wherein a pump is disposed between the second connection point and the first container.

2. The liquid treatment agent coating device according to claim 1, wherein the second container is disposed at a second position, the second position being lower than a first position at which the first container is disposed, and wherein the first on-off valve disposed in the removal channel is a normal open type electromagnetic valve.

3. The liquid treatment agent coating device according to claim 1, further comprising:

a filter unit configured to remove a foreign material in the liquid treatment agent, wherein the filter unit is disposed in the return channel or in the removal channel.

4. The liquid treatment agent coating device according to claim 1, further comprising:

a supply channel configured to supply the liquid treatment agent to the first container, the supply channel being connected to the return channel, wherein a cartridge filled with the liquid treatment agent is detachably connected to a side of the supply channel opposite to a third connection point, the supply channel being connected to the return channel at the third connection point.

5. The liquid treatment agent coating device according to claim 1, further comprising a shutter disposed so as to cover the opening portion of the first container in a first position and to expose the opening portion of the first container in a second position.

6. An image forming system comprising:

a liquid treatment agent coating device configured to coat a recording medium with a liquid treatment agent prior to forming an image on the recording medium; and an inkjet printer configured to form the image by discharging ink droplets onto the recording medium having been coated with the liquid treatment agent, wherein the liquid treatment agent coating device is disposed upstream in a conveyance direction of the recording medium, and the inkjet printer is disposed downstream of the liquid treatment agent coating device in the conveyance direction of the recording medium, wherein the liquid treatment agent coating device is for the inkjet printer, and wherein the liquid treatment agent coating device includes a coating roller configured to coat the recording medium with the liquid treatment agent prior to forming the image on the recording medium;

a pressing roller configured to cooperate with the coating roller to nip and convey the recording medium, wherein the pressing roller is configured to transfer the liquid treatment agent on the coating roller by pressing the recording medium toward the coating roller;

a first container configured to hold the coating roller and the liquid treatment agent, wherein the first container has an opening portion in the vicinity of a nip portion between the coating roller and the pressing roller;

a second container configured to accommodate an amount of the liquid treatment agent held in the first container, a removal channel extending from the first container to the second container, a return channel extending from the second container to the first container, and a bypass channel extending from the removal channel to the midstream of the return channel, wherein a first on-off valve is disposed between a first connection point and the second container, the bypass channel being connected to the removal channel at the first connection point, wherein a second on-off valve is disposed in the bypass channel, wherein a third on-off valve is disposed between a second connection point and the second container, the bypass channel being connected to the return channel at the second connection point, and wherein a pump is disposed between the second connection point and the first container.

* * * * *